US005297991A

United States Patent [19]

Smith

[11] Patent Number: 5,297,991

[45] Date of Patent: Mar. 29, 1994

[54] PORTABLE ELECTRIC FLOOR AND WINDOW FAN

[75] Inventor: Barry W. Smith, Dublin, Ohio

[73] Assignee: The W. B. Marvin Manufacturing Company, Urbana, Ohio

[21] Appl. No.: 105,868

[22] Filed: Aug. 11, 1993

[51] Int. Cl.[5] ..... F24F 7/013

[52] U.S. Cl. ..... 454/208

[58] Field of Search ..... 454/208, 209, 200; 416/63, 244 R, 246, 247

[56] References Cited

U.S. PATENT DOCUMENTS

| | | | |
|---|---|---|---|
| D. 286,673 | 11/1986 | Kahn . | |
| D. 325,432 | 4/1992 | Cook . | |
| 2,547,189 | 9/1947 | Welch, Sr. . | |
| 2,661,895 | 12/1953 | Frick | 454/208 |
| 2,759,412 | 11/1952 | Knapp . | |
| 2,985,092 | 5/1961 | Gamache | 454/209 |
| 4,773,310 | 9/1988 | Corwin . | |
| 5,110,263 | 5/1992 | Chiu | 416/63 |
| 5,184,475 | 2/1993 | Matsumi . | |

OTHER PUBLICATIONS

Advertisement HAWF-2080 published by Holmes Products Corporation, copyright 1990.

Advertisement HAWF-1009 published by Holmes Products Corporation 1992 (copyright dated 1993).

Photographs depicting fan marketed by Duracraft Corporation, Sudbury, Mass. #DW-612; #DW-627.

Advertisement Marvin 2000 published by The W. B. Marvin Manufacturing Company—Sep. 1990.

Advertisement HAWF-3030 published by Holmes Products Corporation 1992.

Brochure titled "Compact Twin Portable Window Fan" Marvin 3000 published by W. B. Marvin Mfg. Co., Oct. 1992.

Copending design patent application Ser. No. 07/929,809 filed on Aug. 13, 1992.

Owner's manual titled "Twin Window Fan" for Model #DW-627 published 1992 by Duracraft Corporation.

*Primary Examiner*—John T. Kwon

*Attorney, Agent, or Firm*—Roger S. Dybvig

[57] ABSTRACT

A combination portable electric floor and window fan is provided with louvered front and rear walls, end walls, a top surface having an upwardly-directed fixed-width V-shaped channel for receiving the lower portion of a frame or sash of a window when window-mounted, and bottom surfaces from which an elongate runner extends downwardly for engaging a window sill. The width and angle of the V-shaped channel accommodates window frames or sash of different thicknesses. The upper portions or legs of the V-shaped channel form handles for lifting and transporting the fan. Pivotally-mounted feet are confined totally within the sides of the runner when the runner is capable of sole bottom support of the fan on an outside portion of a window sill. The feet may be pivoted perpendicularly relative to the runner and the front and rear walls to support the fan either on a floor or by hooking onto an inside portion of a window sill. The runner and V-shaped channel are symmetrical about a common plane extending essentially parallel to and midway between the front and rear walls.

8 Claims, 1 Drawing Sheet

FIG-1
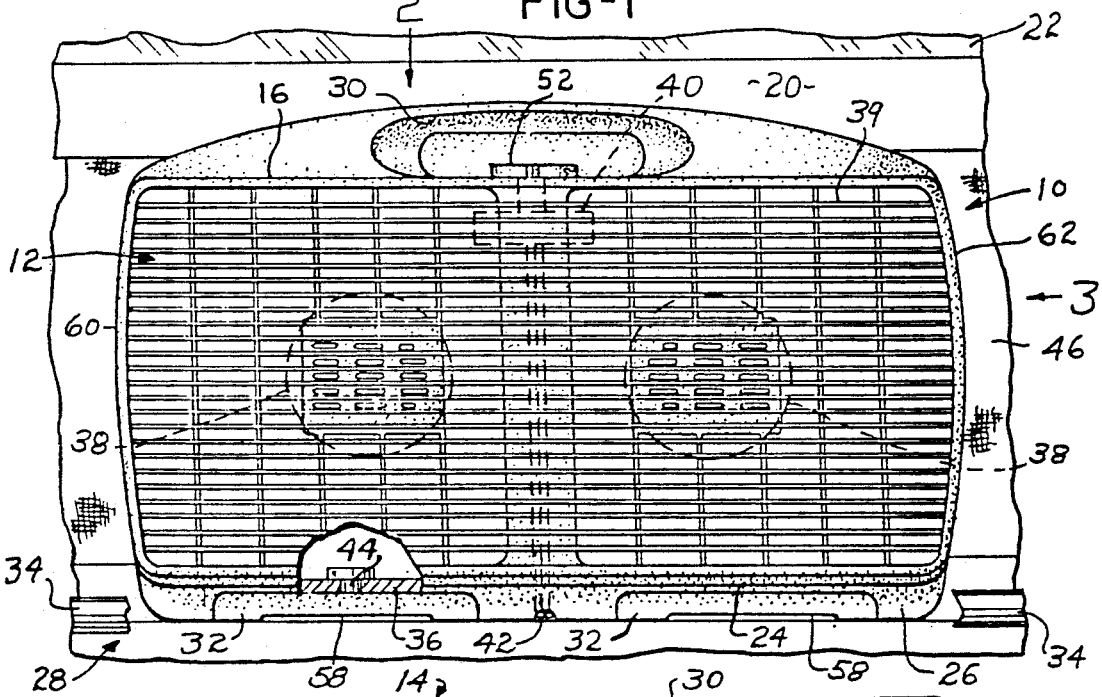
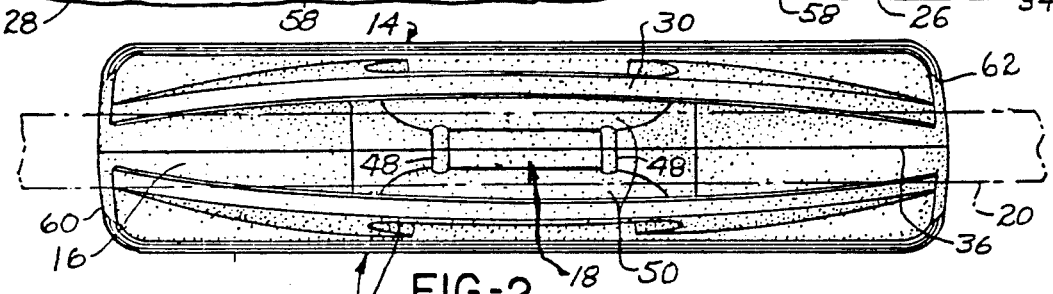
FIG-2
FIG-3
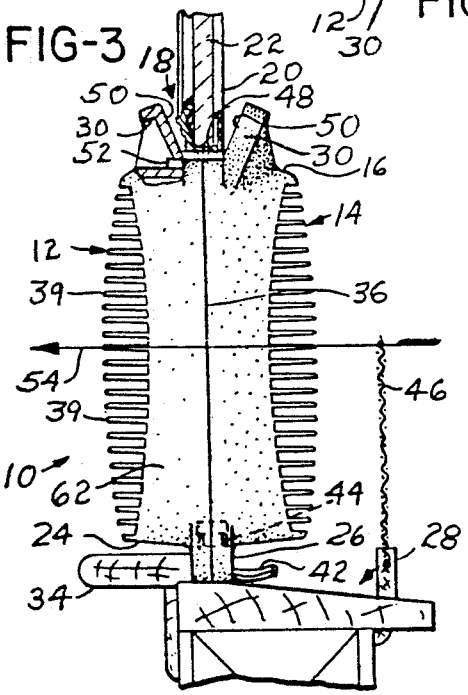
FIG-4
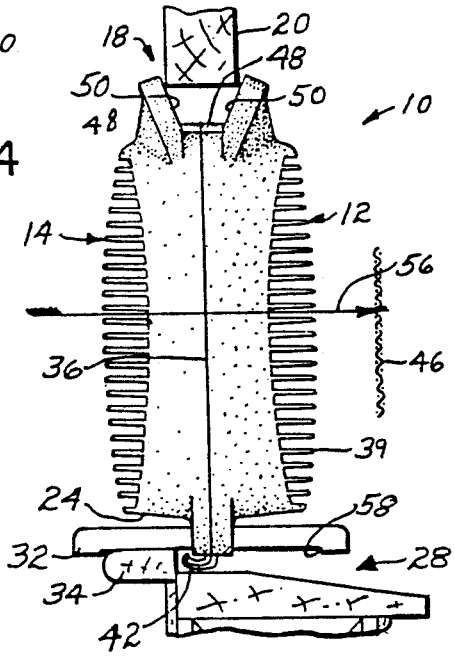

PORTABLE ELECTRIC FLOOR AND WINDOW FAN

This invention relates generally to a portable electric fan unit which may be supported either on a flat surface such as a floor or table or on a sill of an open window for directing air either into or out of a room. In particular, when used as a window fan, the unit accommodates various types and widths of window frames for moving air in either direction therethrough.

BACKGROUND OF THE INVENTION

Fan units which can be used either for moving air between the exterior and interior of a room through an open screened window have been common in the art for a considerable period of time. So too it is known that such a unit can be held steady by window frames to stabilize the unit against tipping or falling. An example of such a fan unit is shown in U.S. Pat. No. 5,110,263, granted to Chiu on May 5, 1992. Welch U.S. Pat. No. 2,547,189, illustrates brackets for fan mounting panel members in a window opening.

However, there remains a need for a portable floor/-window fan unit which easily adapts to exhaust air from or intake air into a room through a screened window, which accommodates a greater variety of window widths than known fan units, and which further does so without being obstructed by a screen for the window opening.

SUMMARY OF THE INVENTION

An elongate, combination portable electric floor and window fan unit is provided with opposing louvered front and rear walls, end walls, a top surface having an upwardly-directed fixed-width V-shaped channel for receiving the lower portion of a frame or sash of a window when the fan is window-mounted, and a bottom surface from which an elongate runner extends downwardly for engaging a window sill. The width and angle of the V-shaped channel accommodates window frames or sashes of different thicknesses. The upper portions or legs of the V-shaped channel comprise handle means for lifting and transporting the fan. Pivotally-mounted feet are confined totally within the sides of the runner when the runner alone supports the fan unit on an outside portion of a window sill, but the feet may be pivoted at right angles to the runner to enable the feet to either support the fan on a floor or to hook onto an inside portion of the window sill. The runner and V-shaped channel are symmetrical about a common vertical plane extending essentially parallel to and midway between the front and rear walls.

A principal object of this invention is to provide a window-mounted electric fan unit capable of intaking air into or exhausting air from a room, which accommodates a large variety of windows of different sash widths, and which centers the unit relative to a sash without the use of tools or movable parts.

Another object of this invention is to provide such a fan unit with a pair of outwardly-directed fingertip recesses forming handles for lifting the fan from either side thereof for transporting, said handles being spaced horizontally and forming a V-shaped channel therebetween for receipt of minimum and maximum-width window sashes.

A further object is to provide such a fan unit with a runner extending downwardly and centrally from the bottom surface thereof in vertical alignment with said V-shaped channel, said runner confining a pair of pivotal fan-supporting feet between the outer sides of the runner, and said runner or said feet selectively providing support for the fan unit on a window sill.

Ancillary thereto, it is an object of the invention to enable such feet to be pivoted perpendicularly to said runner to enable said feet to support the fan on an inner portion of a window sill.

Another object is to provide a longitudinally-extending, V-shaped channel at the top surface of such a fan unit and a longitudinally-extending runner at the bottom surface of said unit in a common vertical plane extending essentially midway between front and rear walls of the fan unit, whereby to enable reversibility of the fan for either intaking or exhausting air through a window opening with the same amount of the fan unit extending on each side of the window.

Other objects will become apparent from the following description in which reference is made to the accompanying drawings.

BRIEF DESCRIPTION OF THE DRAWINGS

FIG. 1 is an elevational view of a fan unit of this invention mounted in a window opening as viewed from inside a room.

FIG. 2 is a top view of the fan unit of FIG. 1 looking downwardly in the direction of arrow 2 and illustrating in phantom a relatively wide window frame or sash.

FIG. 3 is a view looking in the direction of the arrow 3 at the right side of FIG. 1, illustrating the fan unit intaking air into a room. The fan unit is shown as being stabilized at its top surface by a relatively narrow, minimum-width window sash.

FIG. 4 is a view similar to FIG. 3 but with the fan unit reversed to exhaust air from a room, and is shown being stabilized at its upper end by a wider window sash than the sash of FIG. 3.

DETAILED DESCRIPTION

An elongate, combination portable electric floor and window fan unit 10 is provided with louvered front and rear walls 12 and 14 respectively, a top surface 16 having an upwardly-directed fixed-width V-shaped channel 18 for receiving a lower portion of a frame or sash 20 of a window 22 when window-mounted, and a bottom surface 24 from which an elongate runner 26 extends downwardly for engaging a window sill 28. The width and the angle of the V-shaped channel 18 is designed to accommodate window and door frames of a variety of thicknesses. The upper portions of the V-shaped channel 18 comprise handle means 30 for enabling lifting and transporting of the fan unit 10 by one's fingertips. A pair of pivotally-mounted feet 32 are confined totally within the sides of the runner 26 when the runner provides sole bottom support of the fan unit 10 on an outside portion of a window sill. The feet 32 may be pivoted perpendicularly relative to the runner 26 and the front and rear walls 12 and 14 to support the fan unit 10 either on a floor or against the top inside portion 34 of the window sill 28. The runner 26 and the V-shaped channel 18 are centered along a common vertical plane essentially midway between the front and rear walls 12 and 14.

With reference to FIGS. 3 and 4, the fan unit housing is preferably molded from polypropylene plastic in two halves comprising the front and rear walls 12 and 14, respectively. The two housing halves are joined along a parting line which is located in the vertical plane on which the runner 26 and the V-shaped channel 18 are centered. In the embodiment of this invention illustrated herein, the two housing halves are essentially identical except for bosses (not shown) for mounting a pair of motors 38, portions of which can be viewed through louvers 39 in the front wall 12 (FIG. 1). Motors 38 are provided with controls 40 shown in dotted lines in FIG. 1 and are supplied with electrical house current by a cord 42.

The handle means 30 are formed by providing recesses as shown in cross-section at the upper left end of FIG. 3 and at the upper center of FIG. 1. The fan unit 10 is relatively light in weight and can be simply lifted and carried from one location to another by the fingertips of one's fingers in either handle 30. Alternatively, one can span both handles of the V-shaped channel 18 and insert the fingertips of one hand into the recess of one handle 30 and a thumb into the recess of the other handle 30.

The feet 32 are each provided with a cylindrical trunnion 44 as shown in cross-section in FIG. 1. The feet 32 are centered on the parting line 36. They are retained in the unit 10 by placing the trunnions 44 in cylindrical notches which capture the trunnions 44 when the two halves of the housing are brought together to complete the assembly of the fan unit 10. FIG. 1 illustrates the feet 32 being pivoted to positions in which they are confined within the outside edges of the runner 26, constituting the manner in which the unit is window-mounted as shown in FIG. 3. Alternatively, the feet 32 may be pivoted to be perpendicular to the walls 12 and 14 as shown in FIG. 4, either for placing the unit 10 on a floor or for utilizing recessed portions 58 of feet 32 to hook onto the inside portion 34 of the window sill 28. With reference to FIGS. 1, 3, and 4, the fan unit 10 is shown used in a window which is screened by a window screen 46.

A significant aspect of this invention resides in the ability of the V-shaped channel 18, although projecting from fixed housing portions and having no moving parts, to be used with window sashes 20 of various different widths. Thus, the window sash 20 illustrated in FIG. 3 is relatively narrow and rests on top of the fan unit 10 between the two legs of the V-shaped channel. Optionally, the top surface 16 may be provided with upwardly-directed protrusions 48 in the general shape of half-dowels to form a resting surface for the narrow sash 20 of FIG. 3 at the truncated bottom of the V-shaped channel 18 in FIG. 3. Without requiring any movable parts between the sash contacting surfaces of the sides of the channel 18, the same channel 18 can accommodate any width up to a two inch wide sash 20. FIG. 4 illustrates a sash 20 which is wider than the sash of FIG. 3, and therefore, is supported higher in the channel 18 by mutually confronting surfaces 50 formed by the back sides of the recesses which create the handle means 30. With the V-shaped channel 18 being fixed in width, there is no need to use tools to adapt the unit 10 at the top surface 16 for different width windows. Each window is merely lowered into the channel 18 until its two corner edges either contact the surfaces 50 or until the bottom edge of a narrow sash contacts the protrusions 48, as illustrated in FIG. 3. In general, the V-shaped channel 18 is preferably designed to support window sashes ranging from one to two inches in width. FIG. 3 shows a one inch sash and FIG. 4 shows a one and one-half inch sash.

An arrow in FIG. 3 represents air being drawn by the fan unit 10 from the exterior of a room to the interior of the room, that is, from right to left as viewed in FIG. 3. The fan unit 10 is shown turned around in FIG. 4 so that air is exhausted to the right as indicated by the arrow 56. A fan motor control knob 52 is recessed in the top surface 16 and extends through the recesses formed by the handle means 30 so that it is accessible from either side of the fan unit 10. Whether the unit 10 draws air into a room as shown by the direction of the arrow 54 in FIG. 3 or exhausts air from a room as shown by the arrow 56 in FIG. 4, the symmetrical arrangement of all of the elements of the unit 10 allows for ease of placing any width window sash in the V-shaped channel 18 as well as controlling the motors 38 from either side to provide the desired air flow direction. The control knob 52 preferably can be rotated to turn the fans off, to drive the fans at low speeds and to drive the fans at high speeds, using conventional control circuitry.

The runner 26 at the bottom of the fan unit 10, depending upon the construction of the sill 28 of the window unit, can be made to rest directly upon the outside portion of a window sill 28 as shown in FIG. 3, with the feet 32 and the bottom of the runner 26 directly contacting the outside portion but with the feet 32 being confined within the side edges of the runner 26. Alternatively, if it is not easy to find a reasonably level resting surface for the bottom of the runner 26, the feet 32 may be pivoted to their perpendicular relation with the unit 10 as shown in FIG. 4 and can have the recessed portions 58 at the bottom of the feet 32 hook onto the inside edge portion 34 of the window sill 28.

The fan unit 10 of this invention can be placed in practically all double hung windows such as those illustrated in FIGS. 3 and 4. Additionally, a horizontally movable screened sliding door with a vertical opening can receive the same fan unit if it is stood vertically on one of its end walls 60 or 62.

This invention thus provides a floor and window fan which is not only aesthetically pleasing in appearance but also functionally enables simple and easy installation in any of a variety of openings where air is desired to be taken into or exhausted from a room.

Various changes may be made without departing from the spirit and scope of the invention.

Having described my invention, I claim:

1. In a combination portable electric floor and window fan unit having a housing including opposing louvered front and rear walls, end walls and top and bottom surfaces, an electric motor, a fan driven by said motor, a cord for connecting said motor to an electrical supply, and a manually-operable control intermediate said supply and said motor for controlling said motor, the improvement comprising:

an upwardly-directed, V-shaped, fixed-width channel extending longitudinally of said elongate fan unit and atop said top surface for receiving, when said fan is mounted on a horizontal window sill below a vertically movable window, the lower horizontal portion of a frame of said window to restrain the fan against tipping; and, the width and angle of said V-shaped channel being adapted to accommodate receipt of a variety of different thickness window frames.

2. The invention according to claim 1 wherein upper portions of said V-shaped channel comprise handles for enabling manual lifting of said fan when moving it between different locations of use.

3. The invention according to claim 2 wherein said upper portions of said channel include recesses each of a depth permitting several of a person's fingers to enter said recesses to enable lifting said fan with one hand by a single leg of said channel.

4. The invention according to claim 1 wherein a runner extends longitudinally and downwardly below said bottom surface and wherein said runner and said channel portion span a vertical plane extending through said runner and channel portion, said runner being of a lateral horizontal width generally corresponding to a minimum-thickness window frame accommodated by said channel.

5. The invention according to claim 4 including a pair of fan-supporting feet selectively positionable between conditions parallel to and perpendicular to said runner, said feet extending perpendicularly to said front and rear walls for either supporting said fan unit when said unit is placed on a floor, or on a portion of a window sill extending inwardly toward a room when said fan unit is window-mounted.

6. The invention according to claim 5 wherein each foot is recessed upwardly and centrally from points adjacent each of its ends, said recesses enabling one outward end of each foot on the same side of the fan unit to serve as a hook for engaging the inward edge of the sill to restrain the fan unit bottom against movement outwardly of said room.

7. The invention according to claim 5 wherein said runner and said channel portion span a vertical plane extending through said runner and channel portion, and further wherein said runner and said feet are all of a width between their sides generally corresponding to a minimum-thickness window frame accommodated by said V-shaped channel portion, said runner being provided with a pair of upwardly-directed recesses corresponding in length generally to the length of said feet, and means pivotally mounting each foot centrally of its respective runner recess on an axis lying in said plane, for enabling said feet to be repositioned from their perpendicular fan-supporting positions to retracted positions confined totally within the sides of said runner.

8. The invention according to claim 7 wherein each foot is recessed upwardly and centrally from points adjacent each of its ends, said recesses enabling one outward edge of each foot on the same side of the fan unit to serve as a hook for engaging the inward edge of a sill to restrain the fan unit bottom against movement outwardly of said room.

* * * * *